US008051550B2

(12) United States Patent
Cheng et al.

(10) Patent No.: US 8,051,550 B2
(45) Date of Patent: Nov. 8, 2011

(54) METHOD FOR MOUNTING A TRIDIMENSIONAL ANTENNA

(75) Inventors: Kuang-Wei Cheng, Taipei Hsien (TW); Chun-Fa Liao, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 1020 days.

(21) Appl. No.: 11/944,420

(22) Filed: Nov. 22, 2007

(65) Prior Publication Data

US 2008/0122731 A1 May 29, 2008

(30) Foreign Application Priority Data

Nov. 24, 2006 (CN) ..... 2006 1 0157035

(51) Int. Cl.
*H01Q 1/12* (2006.01)
*H01P 11/00* (2006.01)

(52) U.S. Cl. ..... 29/600; 343/700 MS; 343/878

(58) Field of Classification Search ..... 29/600, 29/592.1, 832, 840–842; 343/700 MS, 846, 343/702, 745–748, 829, 830
See application file for complete search history.

(56) References Cited

U.S. PATENT DOCUMENTS

| | | | | |
|---|---|---|---|---|
| 5,943,020 | A * | 8/1999 | Liebendoerfer et al. | 343/702 |
| 6,408,190 | B1 * | 6/2002 | Ying | 455/553.1 |
| 6,850,196 | B2 * | 2/2005 | Wong et al. | 343/702 |
| 7,405,703 | B2 * | 7/2008 | Qi et al. | 343/702 |
| 7,733,274 | B2 * | 6/2010 | Azulay et al. | 343/700 MS |
| 7,764,234 | B2 * | 7/2010 | Tsai et al. | 343/700 MS |
| 2003/0150099 | A1 * | 8/2003 | Lebaric et al. | 29/600 |

FOREIGN PATENT DOCUMENTS

CN 1641929 A 7/2005

* cited by examiner

*Primary Examiner* — Minh Trinh
(74) *Attorney, Agent, or Firm* — Altis Law Group, Inc.

(57) ABSTRACT

A tridimensional antenna includes a radiating body, a feeding foot, a grounding foot, and a supporting foot. The feeding foot and the grounding foot are connected to the radiating body. The supporting foot includes a supporting portion, at least one groove and a bent portion. The bent portion connects the radiating body and the supporting portion. The groove is defined in the supporting portion and adjacent to the bent portion. The tridimensional antenna is mounted on a substrate by surface mounted technology (SMT). The feeding foot and the grounding foot are soldered on the substrate. The supporting foot is bent to break away the supporting portion at the groove after mounting of the tridimensional antenna.

10 Claims, 5 Drawing Sheets

METHOD FOR MOUNTING A TRIDIMENSIONAL ANTENNA

BACKGROUND OF THE INVENTION

1. Field of the Invention

The invention relates to tridimensional antennas, and particularly to method for mounting a tridimensional antenna.

2. Description of Related Art

Wireless communication devices, such as mobile phones, wireless cards, and access points, wirelessly radiate signals via electromagnetic waves. Thus, remote wireless communication devices can receive the signals without the need of cables.

In a wireless communication device, the antenna is a key element for radiating and receiving radio frequency signals. Characteristics of the antenna, such as radiation efficiency, orientation, frequency band, and impedance matching, have a significant influence on performance of the wireless communication device. A tridimensional antenna is employed in order to improve radiation efficiency and vertical polarization radiation performance of an antenna. Usually the tridimensional antenna comprises a radiating body for transmitting and receiving radio frequency (RF) signals, a feeding portion for feeding signals, and a grounding portion. The tridimensional antenna is usually mounted on a substrate by surface mount technology (SMT) in order to improve cost-effectiveness. However, the tridimensional antenna cannot be stably supported on the substrate by the feeding portion and the ground portion thereof during mounting of the tridimensional antenna on the substrate by SMT. Thus, a supporting foot is needed to support the tridimensional antenna during mounting of the tridimensional antenna on the substrate by SMT.

SUMMARY OF THE INVENTION

A method for mounting a tridimensional antenna comprises steps of: providing the tridimensional antenna comprising a radiating body, a feeding foot, a grounding foot, and a supporting foot, the feeding foot and the grounding foot connected to the radiating body, the supporting foot comprising a supporting portion, at least one groove and a bent portion, the bent portion connecting the radiating body and the supporting portion, the groove defined in the supporting portion and adjacent to the bending portion; the tridimensional antenna mounted on a substrate by surface mounted technology (SMT); the feeding foot and the grounding foot soldered on the substrate; and the supporting foot broken away at the groove after mounting of the tridimensional antenna.

Other advantages and novel features will become more apparent from the following detailed description when taken in conjunction with the accompanying drawings, in which:

DETAILED DESCRIPTION OF THE INVENTION

Figure 1:
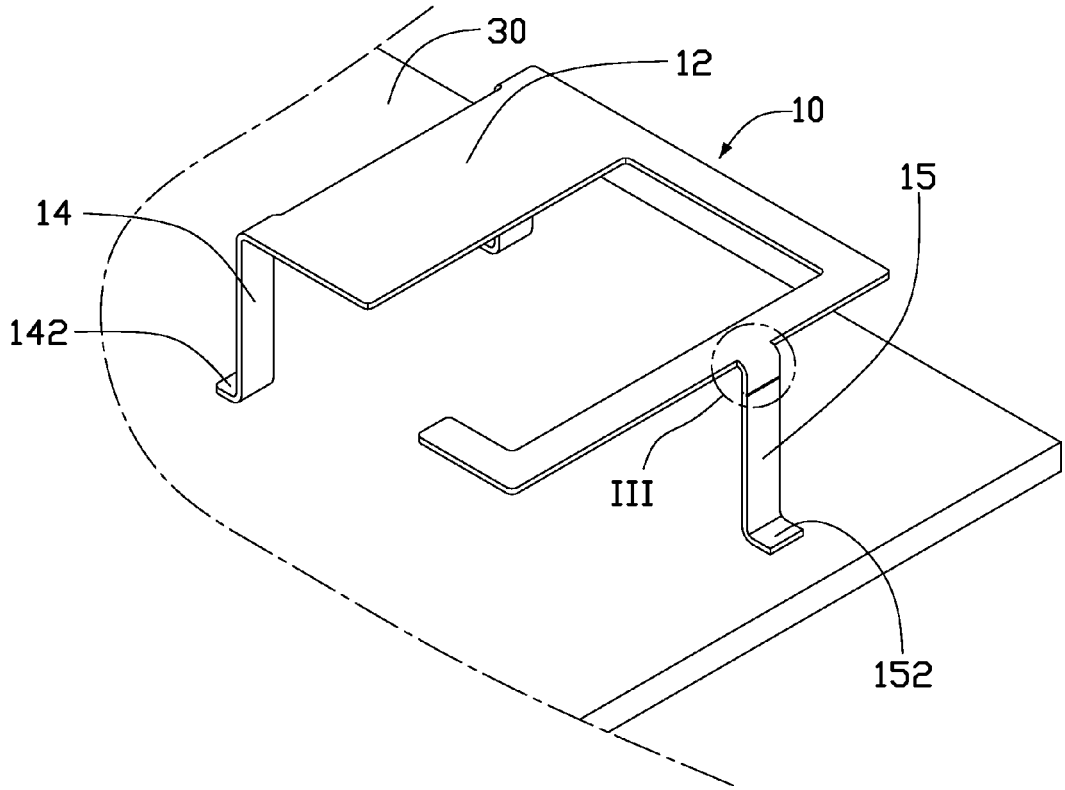
FIG. 1 is an isometric view of a tridimensional antenna in accordance with an exemplary embodiment of the present invention, together with a substrate, the tridimensional antenna comprising a supporting foot.

FIG. 1 is an isometric view of a tridimensional antenna 10 of an exemplary embodiment of the present invention. In the exemplary embodiment, the tridimensional antenna 10 is mounted on a substrate 30.

The tridimensional antenna 10 comprises a radiating body 12, a feeding foot 14, a supporting foot 15 and a grounding foot 16. The radiating body 12 transmits and receives radio frequency (RF) signals, and is parallel to the substrate 30. The feeding foot 14 and the grounding foot 16 are connected to the radiating body 12. The feeding foot 14 is used for feeding radio signals.

Figure 3:
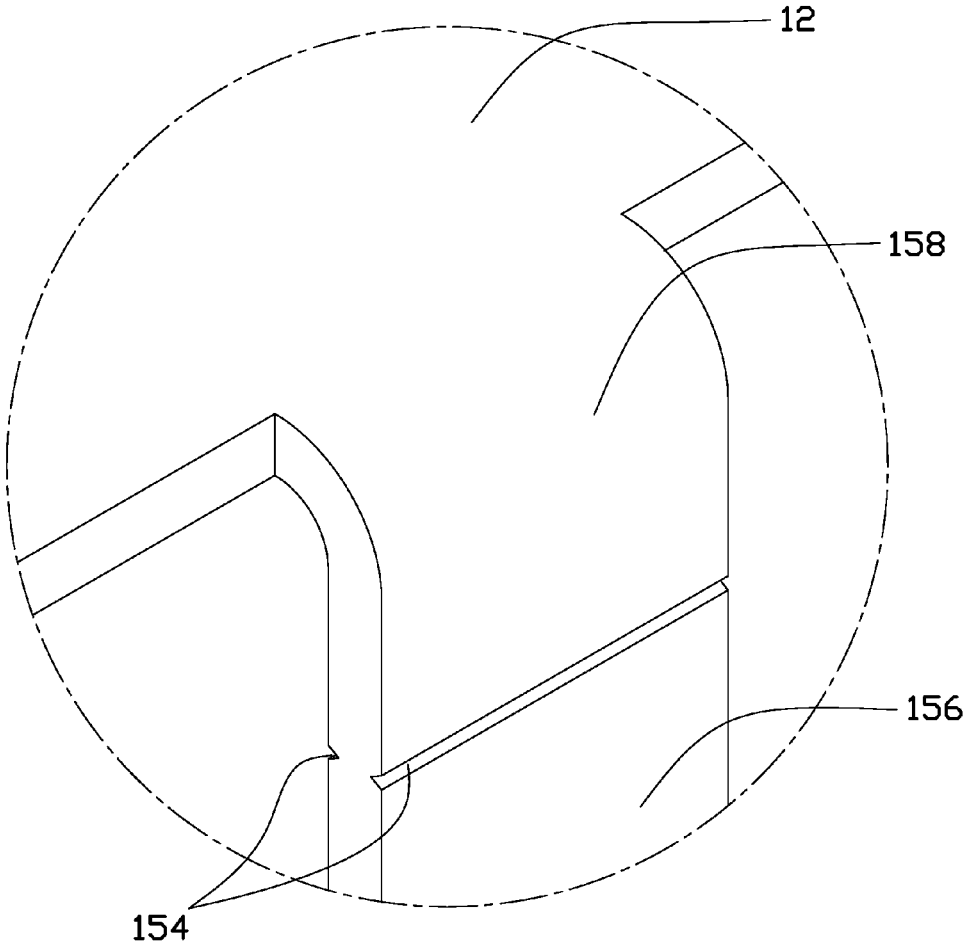
FIG. 3 is an enlarged view of a circled portion III of FIG. 1.

Referring also to FIG. 3, the supporting foot 15 comprises a supporting portion 156, a pair of grooves 154, and a bent portion 158. The bent portion 158 connects the supporting portion 156 and the radiating body 12. The grooves 154 are adjacent to the bent portion 158, and are defined on opposite faces, but in alignment with each other, of the supporting portion 156. In the exemplary embodiment, each of the grooves 156 is V-shaped in cross section.

Figure 2:
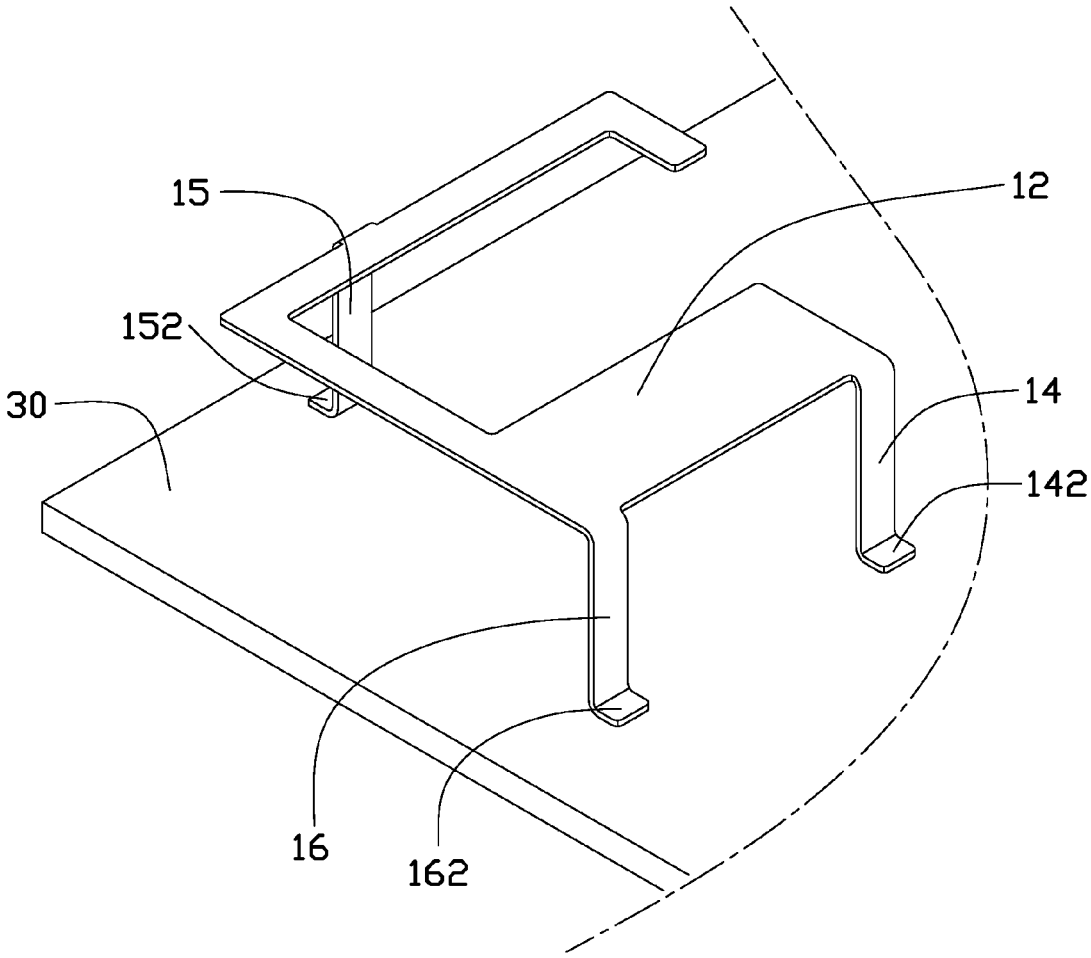
FIG. 2 is similar to FIG. 1, but viewed from another aspect.

Referring also to FIG. 2, the feeding foot 14 comprises a soldering portion 142 disposed at a distal end thereof, and the grounding foot 16 comprises a soldering portion 162 disposed at a distal end thereof. The soldering portion 142 is used for soldering the feeding foot 14 onto the substrate 30 so that the feeding foot 14 is electrically connected to a match circuit of the substrate (not shown). The soldering portion 162 is used for soldering the grounding foot 16 onto the substrate 30 so that the grounding foot 16 is electrically connected to a grounding portion of the substrate 30 (not shown). The supporting foot 15 comprises a distal end portion 152 for abutting again the substrate 30. The soldering portion 142 of the feeding foot 14, the soldering portion 162 of the grounding foot 16, and the end portion 152 of the supporting foot 15 have a same or similar shape, which in this embodiment is rectangular. The feeding foot 14 and the grounding foot 16 are connected to a side of the substrate 30, and the supporting foot 15 is connected to another side of the substrate 30. That is, the feeding foot 14, the grounding foot 16 and the supporting foot 15 form a triangular support configuration to stably support the radiating body 12 of the tridimensional antenna 10 on the substrate 30.

Figure 4:
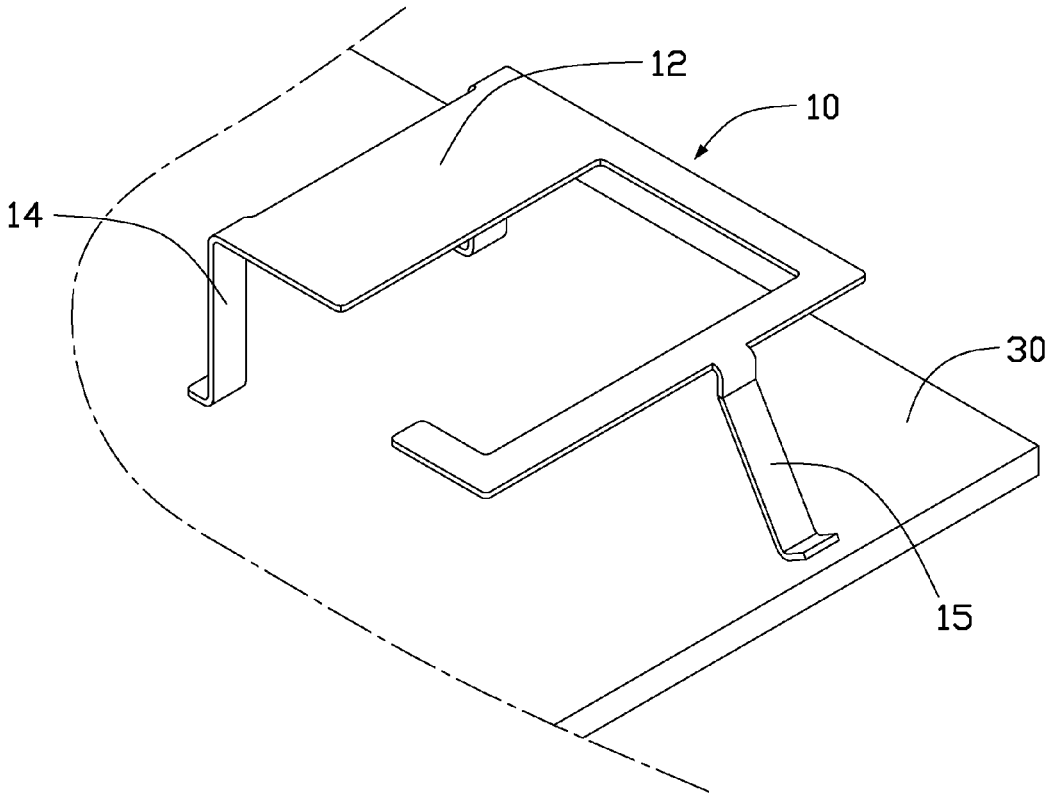
FIG. 4 is similar to FIG. 1, but the supporting foot of the tridimensional antenna is being broken away.
Figure 5:
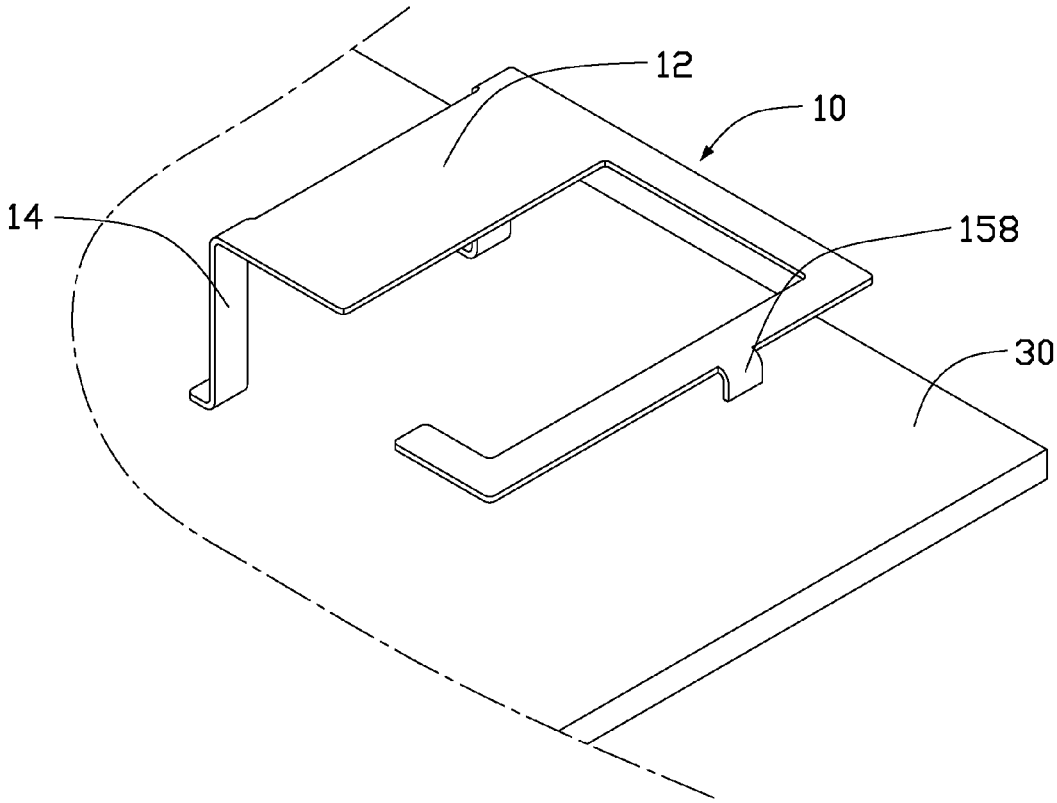
FIG. 5 is similar to FIG. 1, but without the supporting foot of the tridimensional antenna.

Referring to FIGS. 4 and 5, in assembly, the tridimensional antenna 10 is mounted on the substrate 30 by SMT, and the soldering portion 142 of the feeding foot 14, and the soldering portion 162 of the grounding foot 16 are soldered onto the substrate 30. During the course of SMT, the supporting foot 15 is used for stably supporting the tridimensional antenna 10 on the substrate 30. After the tridimensional antenna 10 is soldered onto the substrate 30, the supporting foot 15 is bent to break away the supporting portion 156 at the grooves 154, and removed.

Because the feeding foot 14, the grounding foot 16, and the supporting foot 15 form the triangular configuration, the tridimensional antenna 10 can be stably supported on the substrate 30 during the course of SMT.

Because, the grooves 154 are defined in opposite faces of the supporting foot 15, the supporting foot 15 can be easily broken away.

While an exemplary embodiment has been described above, it should be understood that it has been presented by way of example only and not by way of limitation. Thus the breadth and scope of the present invention should not be limited by the above-described exemplary embodiments, but should be defined only in accordance with the following claims and their equivalents.

What is claimed is:

1. A method for mounting a tridimensional antenna, comprising:

providing the tridimensional antenna comprising a radiating body, a feeding foot, a grounding foot, and a supporting foot, the feeding foot and the grounding foot connected to the radiating body, the supporting foot comprising a supporting portion, at least one groove and a bent portion, the bent portion connecting the radiating body and the supporting portion, the groove defined in the supporting portion and adjacent to the bent portion;

mounting the tridimensional antenna mounted on a substrate by surface mounted technology (SMT);

soldering the feeding foot and the grounding foot soldered on the substrate; and bending to break away the supporting portion of the supporting foot broken away at the groove after mounting of the tridimensional antenna.

2. The method as claimed in claim 1, wherein the at least one groove comprises a pair of coplanar grooves defined in opposite faces of the supporting portion.

3. The method as claimed in claim 1, wherein each of the grooves is V-shaped in cross section.

4. The method as claimed in claim 1, wherein the feeding foot, the grounding foot, and the supporting foot form a triangular configuration for supporting the radiating body.

5. The method as claimed in claim 1, wherein the feeding foot comprises a soldering portion disposed at a distal end thereof, and the grounding foot comprises a soldering portion disposed at a distal end thereof.

6. The method as claimed in claim 5, wherein the supporting foot further comprises a distal end portion on end of the supporting portion before mounting the tridimensional antenna, and the end portion of the supporting foot and the soldering portions of the feeding foot and the grounding foot have a similar shape.

7. The method as claimed in claim 6, wherein each of the end portion of the supporting foot and the soldering portions of the feeding foot and the grounding foot is a rectangular plate.

8. A method for mounting a tridimensional antenna to a substrate, comprising:

forming said tridimensional antenna comprising a radiating body for signal transmission spaced away from said substrate, and a feeding foot for signal feeding extending from a first side of said radiating body toward said substrate so that a soldering portion of said feeding foot is reachably placed on said substrate;

forming at least one supporting foot extending from a second side of said radiating body different from said first side thereof toward said substrate so as to reachably engage with said substrate for supporting said radiating body at said second side thereof;

forming at least one groove on each of said at least one supporting foot so that said each of said at least one supporting foot is separable from said radiating body right at said at least one groove;

soldering said soldering portion of said feeding foot onto said substrate for electrical connection between said feeding foot and said substrate; and removing said supporting foot by separating said supporting foot from said radiating body at said at least one groove.

9. The method as claimed in claim 8, wherein each of said at least one groove is V-shaped in cross section.

10. The method as claimed in claim 8, wherein a curved bent portion is defined between said radiating body and said at least one groove.

* * * * *